United States Patent [19]

Steeger et al.

[11] Patent Number: 4,599,536

[45] **Date of Patent: * Jul. 8, 1986**

[54] SINGLE-ENDED LOW-PRESSURE DISCHARGE LAMP, SUCH AS FLUORESCENT LAMP, AND METHOD OF ITS MANUFACTURE

[75] Inventors: Gerhard Steeger; Josef Plischke, both of Augsburg, Fed. Rep. of Germany

[73] Assignee: Patent-Treuhand-Gesellschaft für elektrische Glühlampen mbH, Munich, Fed. Rep. of Germany

[ * ] Notice: The portion of the term of this patent subsequent to Apr. 3, 2001 has been disclaimed.

[21] Appl. No.: 581,826

[22] Filed: Feb. 21, 1984

[30] Foreign Application Priority Data

Mar. 4, 1983 [DE] Fed. Rep. of Germany ..... 3307780

[51] Int. Cl.[4] ..... H01J 1/92; H01J 9/26

[52] U.S. Cl. ..... 313/493; 313/318; 445/26

[58] Field of Search ..... 313/493, 318, 609, 610, 313/634; 445/26

[56] References Cited

U.S. PATENT DOCUMENTS

| | | | |
|---|---|---|---|
| 4,199,708 | 4/1980 | Lauwerijssen et al. | 313/493 |
| 4,441,050 | 4/1984 | Steeger et al. | 313/318 X |
| 4,510,415 | 4/1985 | Ogata et al. | 313/493 |

OTHER PUBLICATIONS

Popular Science, Nov. 1983, pp. 22, 24, 26 "Folded Fluorescents".

*Primary Examiner*—Palmer C. Demeo
*Assistant Examiner*—Sandra L. O'Shea
*Attorney, Agent, or Firm*—Frishauf, Holtz, Goodman & Woodward

[57] ABSTRACT

A single-ended low-pressure discharge lamp, such as a fluorescent lamp, is made by providing an inner glass base structure which has a depending portion (2) extending towards the base (14) of the lamp, and an upper flange or rim portion (3) to which the bulb (10) is melted-on as a last step. Two U-shaped tubes (5, 5') are melted-in into an oval deformed region of the depending projecting end portion (2), a pre-heatable electrode (12, 12') being also located within the end region (**8, 8*a***) of the U-shaped tubes, so that, in one working step, after deformation of the glass U-shaped tubes and the glass inner base structure, a press operation will seal together the electrodes within the ends of the U-shaped tubes, the glass of the U-shaped tubes and the inner base structure. The glass of the U-shaped tubes is coated with a phosphor, resulting in a long discharge path, through both of the U-shaped tubes, permitting direct replacement of screw-type based incandescent lamps by the thus formed fluorescent unit, after placing a bulb over the U-shaped tube and attachment to the rim, and introducing a fill including mercury. The axially depending end portion, being generally oval in cross section, leaves space laterally of the elongated sides of the oval between a circular base for positioning, for example, of starter and ballast elements.

18 Claims, 7 Drawing Figures

SINGLE-ENDED LOW-PRESSURE DISCHARGE LAMP, SUCH AS FLUORESCENT LAMP, AND METHOD OF ITS MANUFACTURE

Reference to related applications, assigned to the assignee of the present invention, the disclosure of which is hereby incorporated by reference:

Ser. No. 557,670, filed Dec. 2, 1983, POREMBSKI et al

Ser. No. 415,451, filed Sept. 7, 1982, STEEGER et al. now U.S. Pat. No. 4,441,050

Literature Reference: "Popular Science", November 1983, pp. 22, 24, 26, "FOLDED FLUORESCENTS", article by David Scott and Susan Renner-Smith.

U.S. Pat. No. 4,199,708.

The present invention relates to low-pressure discharge lamps, such as fluorescent lamps, which are secured to a single-ended base, to a method of manufacturing the lamp, and of a base component, and more particularly to the internal base connection of the lamp, and its electrodes.

BACKGROUND

Various types of single-ended fluorescent lamps have been proposed, see, for example, the referenced U.S. patent application Ser. No. 415,451, filed Sept. 7, 1982, STEEGER et al., and descriptive literature such as "Popular Science", November 1983, pages 22, 24, 26 "FOLDED FLUORESCENTS", article by David Scott and Susan Renner-Smith. Single-ended fluorescent lamps, referred to as compact fluorescent lamps, have substantial advantages with respect to the customary elongated fluorescent lamps due to their small space requirements. A ballast and starting circuit can be constructed small enough so that it is retained within the base construction, or a small base extension. These lamps, then, can be fitted with customary "Edison" screw threads and used as direct replacement for incandescent lamps of various wattage ratings. Compact lamps of this type, due to their special construction, are thus suitable for direct replacement of customarily used incandescent lamps but, due to their substiantially higher conversion efficiency from electrical power into light energy, and their longer life, the lamps are substantially more economical in use. Compact lamps of this type did not, however, as yet achieve the market acceptance which their advantages would indicate due to the high initial cost thereof. The internal construction of these lamps still is too complex, resulting in excessive manufacturing costs, and, consequently, eventual cost to the user for the lamp itself which is above the threshold of commercial acceptance. Lamps of simpler construction do not have the substantially higher electrical-to light conversion efficiency, so that, even though the price may be less, the incentive for their use is also less. Development of compact fluorescent lamps thus has an aim to provide for high electrical-to-light conversion efficiency, a light color spectrum which is acceptable for universal use and renders color illuminated by the lamp essentially with the same quality as daylight, or acceptable fluorescent lamps, and additionally permits construction with respect to size and shape approaching that of incandescent lamps, while permitting manufacture so that the lamps can be sold at a price level which is competitive with incandescent lamps.

It has previously been proposed—see German Patent Disclosure Document No. DE-OS 28 35 574, to which U.S. Pat. No. 4,199,708 corresponds—to construct a single-ended low-pressure lamp in which an outer bulb surrounds a preheatable electrode which is located within one end of a generally U-shaped tube located within the outer bulb. The electrode is included in the U-shaped tube by a gas-tight melt. Gas-tight connection between the U-shaped inner tube and the preheatable electrode, as well as with the outer bulb which includes a gas filling, is made by using a connecting melt glass which is bonded to a chromium steel plate, forming a base section. The various components of the lamp, soldered or otherwise bonded together, require a plurality of manufacturing steps which are expensive, resulting in overall high cost of the lamps. In mass production, it has been found that the multiplicity of melt connections may introduce manufacturing defects, so that the overall reject rate of the lamps, due to possibly slightly leaking joints, was excessive and beyond acceptable commercial levels.

It has also been proposed to construct single-ended fluorescent lamps by using a pre-formed accepting plate which has an axial extension in form of a stem, extending within the bulb itself. The electrode and the U-shaped inner tube are secured to this element, and the outer bulb is then melt-connected to the dish-shaped side of the base-and-stem unit formed thereby.

This construction, like the one utilizing a metal base, has an additional disadvantage: The electrodes will be positioned above the edge of the base. The space surrounding the electrodes, as well known in connection with fluorescent lamps, may become blackened. This blackened area then will be visible. The open end of the U-shaped inner tube will be above the edge of the base. If no fluorescent coating is applied, for example, to the inner surface of the outer bulb, the blueish mercury vapor discharge will be visible when the lamp is in operation, which is undesirable due to distortion of color rendition of light emitted from the lamp and interferes with consumer acceptance thereof.

Various lamps of this type use not only one, but a pluarlity of inner tubes, for example two, which are located parallel to each other within the interior of the bulb.

THE INVENTION

It is an object to provide a low-pressure discharge lamp, particularly a fluorescent lamp, which is single-ended, and suitable for direct replacement of incandescent lamps, which has excellent electrical-to-light energy conversion efficiency, is at least roughly comparable in shape, size and light emission, to incandescent lamps, and thus can be used as direct replacement in various types of lamp fixtures for incandescent lamps. Additionally, the construction should be such that the lamp can be made by automatic machinery with high output to permit offering to the consumer a lamp product which is comparable in price and quality to incandescent lamps, considering the higher conversion efficiency thereof, and at reasonable and commercially acceptable initial cost. Additionally, the construction should be such that only intended useful visible light is emitted from the lamp, and other light phenomena arising within the lamp are shielded from view by the user.

Briefly, the base structure comprises a unitary glass element which has a cup-shaped or dished upper portion. The element is made of a glass which is compatible with and meltable to the bulb. The upper dished portion is formed with an outwardly extending flange or ridge concentric with the major axis of the bulb and, after assembly, is melted thereto. The element has a depending end portion, extending towards the base, that is, away from the bulb which, in cross section, has a longitudinal, for example approximately oval shape. Two pre-heatable electrodes are melted into that end portion, and one end of the leg of a U-shaped tube, the other of which is shorter, is likewise melted thereinto; one of the electrodes is melt-connected into the longer one of these ends of the U-shaped tube. If two U-shaped tubes are used, one electrode, each, can be melted into the longer one of the legs of the U-shaped tube. The end portion is connected to the rim or dished portion by a cylindrical intermediate portion. The cylindrical intermediate portion, thus, spaces the melt connection of the U-shaped tube and of the electrodes away from the dished rim or flange, so that the bulb will be located above the region of the melted-in connections. The electrodes are connected to suitable terminals, within the lamp connecting base or externally thereof. Due to the longitudinal shape of the lower end portion of the inner base structure of the lamp, space is available adjacent that portion and the outer connecting lamp base which may be used, for example, for placement of compact starting circuitry and the like, for example including integrated circuit-type semiconductor units.

The lamp has the advantage that the power conversion efficiency is enhanced due to increased length of the discharge arc, permitting operation of the lamp at an operating voltage higher than before possible. By placing two pre-heatable electrodes, each in their own U-shaped inner tube, a particularly good conversion efficiency is obtained due to the long discharge path then achieved. The longitudinal axes of the legs of two U-shaped inner tubes are preferably so located that they, in general, are the corner points of a rectangle, or a rhombus, the diagonals of which define an intersection located on the longitudinal axis of the lamp.

In accordance with a feature of the invention, the U-shaped tubes are secured to a subassembly formed by a unitary glass element including the dished portion, the end portion and the connecting portion, which, during manufacture, is deformed to constitute a press which has, approximately, the length of the end portion which receives the U-shaped tube and the melted-in electrodes. In accordance with a preferred feature, the portion to be pressed has a constriction at its middle so that, in cross section, it has an approximately "8" shape. To form the final fluorescent lamp, a mercury-vapor fill is introduced into the bulb, and suitable phosphors are applied either to the discharge tubes, to the interior of the bulb, or to both; alternatively, the interior of the bulb may be formed of clear glass, frosted glass, or silicated glass.

In accordance with a feature of the invention, the lamp is made by first constructing the unitary inner base element by placing a glass blank on a rotating mandrel which, after softening of the glass, is then pre-shaped to the desired outline by introducing, from the top, through the hollow cylindrical portion, a suitable die having the desired shape; rotation of the unit is then stopped, and outwardly located, inwardly operating jaws press the glass into the desired shape. The subsequent manufacture of the lamp, in accordance with another feature of the invention, includes locating the electrodes in the end or support portion, the electrodes first having been located on a subassembly including a glass bead or electrode holding stem which can be introduced into the end portion. The extended leg of the U-shaped tube is pushed over the connected electrode-stem or bead subassembly to surround the electrodes. The U-shaped tubes may already have been pre-coated with fluorescent material, except for the end region which is to be fitted into the end or support portion of the inner base structure. The assembled elements are then heated to a temperature suitable for deformation and sealing of the glass, and connected together in a press operation, as well known in light bulb manufacturing technology. This operation, then, permits sealing the U-shaped inner tube, the electrode assembly, and the inner base structure together in air-tight manner, in one single manufacturing operation. The outer bulb is then melted-on to the flange or dish-shaped element at a position concentric to the longitudinal axis of the lamp; melting-on can be carried out by permitting the glass to melt down under its own weight, that is, under gravity, or pressing the bulb by means of a heated roller against the softened flange or disk portion of the inner base structure. An exhaust tube can be melted into the inner base structure at the same time the electrodes and the U-shaped tubes are positioned. After exhausting the lamp, filling with a suitable gas such as argon and a dose of mercury, a connecting base is placed on the lamp, and the lamp is ready for operation.

The lamp has the advantage of compact outer dimensions and high electrical-to-light conversion efficiency. The specific construction is substantially simpler than prior art constructions and readily adaptable to mass production technology on automatic machinery. The length of the discharge path is extended, particularly if two U-shaped tubes are used within the lamp. Use of a pre-formed or pre-shaped inner base structure of glass, in which a cylindrical connecting portion terminates in the essentially oval end or supporting portion for the electrodes and the tubes, directed towards the base rather than into the interior of the bulb, has the additional advantage that the electrodes as well as the open ends of the U-shaped tubes will be located below the edge of the base and thus no blueish discharge light will be visible to the user, since the opening of the U-shaped tube will be located below the rim of the inner base structure.

Positioning the press region below the rim of the inner base structure has the additional advantage that the length of the useful discharge path is further extended, namely by essentially the axial length of the inner base structure, so that, in comparison to previously known compact fluorescent lamps, higher lamp output can be obtained with lamps of equal external size. The space which will become available at both sides of the press, when the press is inserted in an outer base of circular outline, can be used to locate accessory circuitry.

DRAWINGS

FIG. 1 is a schematic side view of an inner base in accordance with the invention, oriented for location within a lamp in upright-mounted position;

FIG. 2*a* is a top view of a first embodiment of the inner base;

FIG. 2*b* is a top view of another embodiment of the inner base;

DETAILED DESCRIPTION

Figure 1:
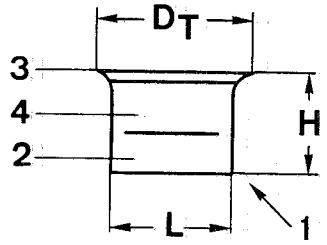
Figure 2A:
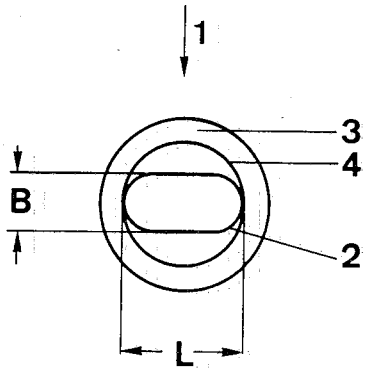
Figure 3:
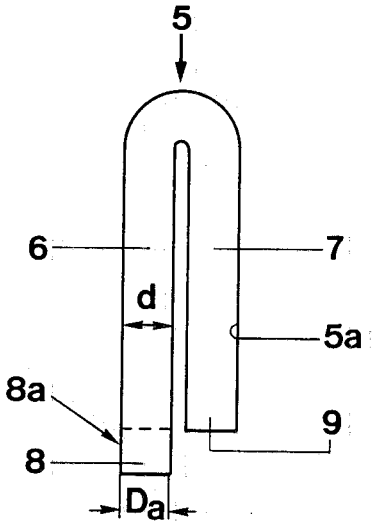
FIG. 3 is a side view of a U-shaped tube.
Figure 2B:
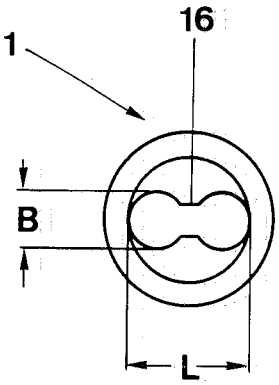
Figure 4:
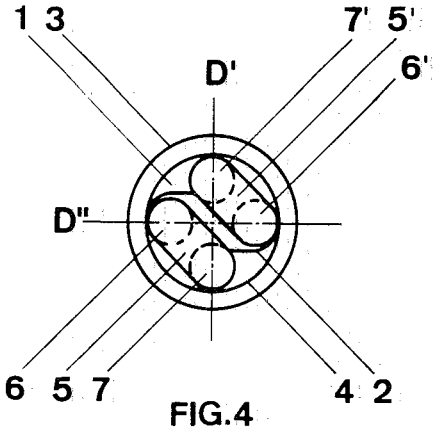
FIG. 4 is a top view of two U-shaped tubes assembled in a base, before the U-shaped tube and the base are connected by a press operation.
Figure 5:
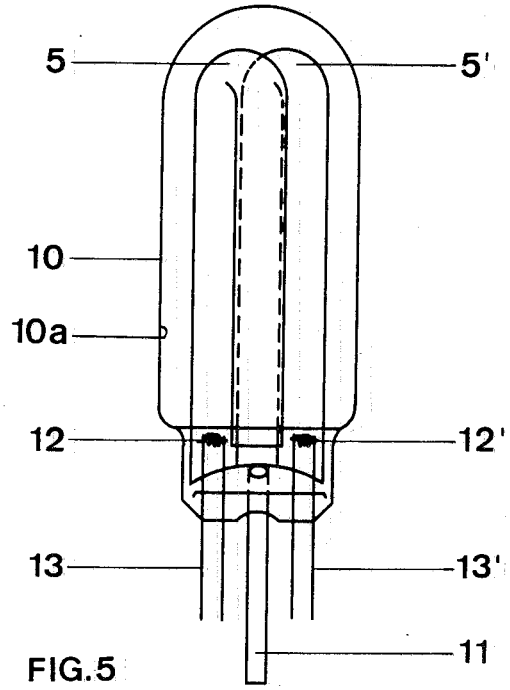
FIG. 5 is a side view of the lamp connected to the inner base.
Figure 6:
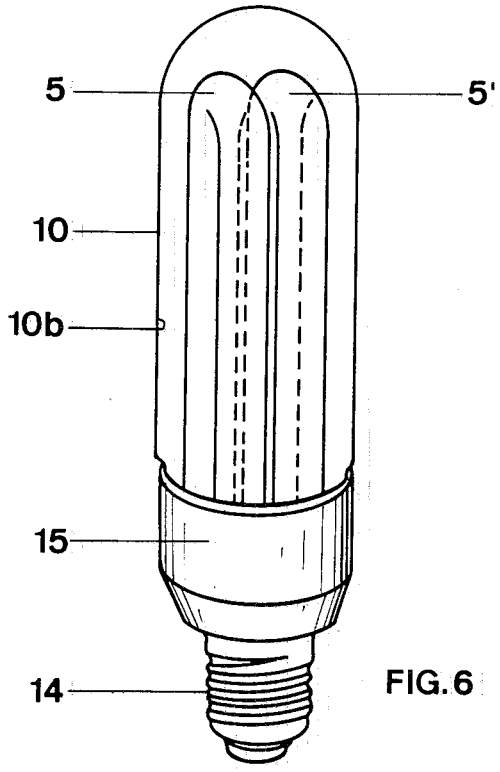
FIG. 6 is a side view of the finished lamp, with a transparent envelope.

An inner base structure 1 (FIGS. 1, 2*a*, 2*b*) is first made. The inner base structure 1 has an upper rim or flange portion 3, which is outwardly directed. In plan view, the rim 3 is circular—see FIGS. 2*a*, 2*b*. The rim 3 will, later on, form the melt connection line with an outer bulb 10 (FIGS. 5, 6). In accordance with a feature of the invention, the inner base structure extends in the direction towards the finished lamp base 14 (FIG. 6) and forms, at its terminal end, an end or support portion 2. The end or support portion 2 is deformed from the circular, and, in cross section, defines an essentially elongated oval opening, as best seen in FIG. 2*a*. This opening is dimensioned to receive the first end of at least one, and preferably on either terminal portion, the ends of two U-shaped inner tubes 5, 5' (FIGS. 3, 4). The inner clearance dimension B (FIG. 2*a*) is matched to the outer diameter of the inner U-shaped tubes 5, 5'. The transverse dimension or length L corresponds roughly to the length of the press which will be formed during manufacture of the lamp. In accordance with an embodiment of the invention, as illustrated in FIG. 2*b*, the rounded longitudinal oval portion 2 is formed with a central constriction 16 so that, in cross section, the end portion 2 has approximately the shape of an "8". The rim 3 and the end or support portion 2 are connected by a connecting portion 4 which, in general, is cylindrical in aspect, and which has a diameter which is less than the diameter of the flange or rim 3. Preferably, the diameter corresponds roughly to the transverse length L of the support or end portion 2.

In one example of an embodiment, the following dimensions have been found suitable (all dimensions approximate):

height H of inner base structure 1: 25 mm diameter $D_T$ of rim or flange 3: 37 mm to 40 mm transverse length L of support portion 2, and diameter of connecting portion 4: 30 mm outer diameter $D_a$ of discharge tube 5: 12 mm inner diameter d of discharge tube 5: 10 mm wall thickness of discharge tube 5: 1 mm space between the legs 6, 7 of the bent U-shaped discharge tube: 3 mm outer diameter of bulb 10 (FIGS. 5, 6): 38 mm to 50 mm.

The U-shaped inner tube 5—see FIG. 3—has two parallel elongated legs 6, 7. The first leg 6 is somewhat longer than the second leg 7, for example extended by an end portion 8 of about 10 mm. The elongated end portion 8 is utilized to introduce the tube 5 into the support portion 2 of the inner base 1. The opening 9 of the leg 7 will remain free, communicating with the interior of the lamp. The tube 5 is usually coated with a fluorescent phosphor; the region 8*a* at the end portion 8 of the leg 6 is free from phosphor coating.

In accordance with a preferred feature of the invention, tw such tubes 5, 5' are assembled to a single base structure—see FIG. 4. The four legs 6, 7 and 6', 7' are located parallel to each other, the longitudinal axes forming the corner points of a rhombus or of a square. The diagonal lines D', D'' intersect at the longitudinal axis of the lamp. Pre-heatable electrodes—not shown in FIG. 4—are located in a melted-in region within the end portions 8 of the legs 6, 6', for example secured to a stem or bead or pearl.

In manufacture, the electrodes, pre-mounted on their respective stems, the tubes 5, and the base structure 1 are assembled together, and heated. The support or end portion 2 is then heated, along the length L thereof, and sealed as a press. An exhaust tube 11 (FIG. 5; omitted from FIG. 4 for clarity) is introduced into the end portion 2 before pressing and sealing the electode stem and the tubes 5, 5' in the end and support portion 2.

The subassembly is seen in FIG. 4. An outer bulb 10, having an outer diameter of between 38 to 50 mm, is then placed thereover. The outer bulb 10 may additionally be coated with a fluorescent coating 10*a* (FIG. 5) or may be internally frosted or supplied with a light diffusing coating, shown schematically at 10*b*, FIG. 6. The manufacturing stage of connection of the bulb 10 to the subassembly is seen in FIG. 5. The exhaust tube 11 extends from the bottom zone of the subassembly and into the interior of the lamp. The preheatable electrodes 12,12' are located in the end portions 8 of the respective tubes 5, 5', each having extended connecting lead pairs 13, 13'. The connecting lead pairs 13, 13' may be unitary or multi-component elements. A copper-jacketed wire is particularly suitable.

The lamp is then exhausted and filled with a suitable fill, and the exhaust and filling tube 11 is, thereafter, sealed. These steps can be carried out in accordance with well known and standard lamp manufacturing technology. The final lamp is shown in FIG. 6, in which an outer base 14 is connected, for example with a screw base, for example for introduction into a socket and direct replacement of an incandescent lamp. The base 14 can be connected to a socket sleeve 15 in which, for example, a starting and ballast circuit can be located.

In a typical example, the tubes 5, 5' each have a path length of about 23 cm, so that the discharge path length from one electrode 12 to the other electrode 12' will be about 46 cm. A lamp of this type may be filled with a fill of mercury of about 10 mg, and 300 Pa argon. Such a lamp will have a power consumption of 16 W, a discharge arc maintenance voltage of about 95 W and a lamp current of about 200 mA. The light output of the 16 W will be about 1000 lm.

The outwardly directed rim 3 of the inner base structure is circular, concentric with the longitudinal axis of the lamp. The diameter is matched to the diameter of the bulb at the attachment zone. Preferably, the inner surface of the bulb is made to be light-diffusing. The gas-tight melt connection between the rim 3 and the bulb 10 can be made in conventional manner by suitable and well-known melting machinery, customary in the manufacture of incandescent lamps. The hollow cylindrical portion of the inner base structure which merges into the end or support portion preferably has a diameter which is roughly equal to the length of the support portion; it is, of course, of smaller diameter than the outer rim 3 of the inner base structure.

The fill contains, preferably, mercury and a noble gas. A substance forming an amalgam may be located within the interior of the U-shaped tubes adjacent the press seal, particularly if very narrow interior U-shaped tubes are used. The amalgam-forming material is suitably selected, as well known, to recycle mercury which, due to thermal conditions which arise in operation is brought from the outer bulb back to a continuous dynamic cycle. Thus, the entire volume, and specifically the entire volume within the tubes 5, 5', will always be filled essentially uniformly with mercury vapor. Ultraviolet (UV) radiation which is generated during the low-pressure discharge is converted into light radiation by suitable coatings 10*a* (FIG. 5) at the interior of the bulb, or coatings 5*a* in the interior of the respective tubes 5, 5', or coatings formed both on the bulb and within the tubes. In accordance with a preferred feature of the invention, a three-component fluorescent substance is preferably used, which has individual components emitting radiation in the red, green and blue color ranges.

Various coatings are suitable for the outer bulb, unless it is used as a support structure for fluorescent material, and different shapes and arrangements are possible. The bulb may be clear glass, for example as used in incandescent lamps, or may be interiorly formed with a light-diffusing surface, for example an inner frosting surface, or a silicate coating.

The outer bulb has a base zone in the region of the end in which the electrodes are located, over which electrical connection of the finished lamp can be effected. Preferably, the outer base is formed with a terminal end portion which has a customary screw base, to be used with a standard screw socket, for direct replacement with incandescent lamps. Of course, other types of bases may be used. Combination of the base together with a ballast and starting circuitry to permit direct operation of the lamp as an independent, integral unit is possible. Direct replacement of the lamp, thus, for an incandescent lamp, becomes feasible. The lamp may, however, also be constructed differently for use with external accessory elements, such as external chokes, starters, and the like, which may be integrated with a lamp fixture, or which are constructed as separate adapter elements to be used with the lamps, or with a fixture.

The lamp is easily made. In accordance with a feature of the invention, the inner base structure, with the dished rim, is constructed by utilizing a glass tube having a diameter which corresponds to the diameter of the hollow cylindrical intermediate portion 4 of the inner base structure. One end, after softening, is expanded to form the rim or flange portion 3, thus forming the externally directed rim. The intermediate element so made is then placed, with the edge downwardly, into a rotating receptacle, and then heated at the upper remaining portion to a temperature permitting deformation of the glass. The dished unit, with the end portion, previously cut to suitable longitudinal dimension H, or slightly thereover, is then pushed on a receptacle mandrel which has an inner shape corresponding to the final shape which the base structure is to have, that is, a cylindrical portion merging into the rounded, essentially oval portion corresponding to the end or support portion 2 of the inner base structure 1. The rotary movement is stopped, and two outer shaping jaws are moved towards the blank, softened at the end, to press the glass into the shape shown in FIGS. 1 and 2*a*, 2*b*. The oval opening may have straight sides—FIG. 2*a*, or may have a central constriction 16, see FIG. 2*b*, similar to a figure "8". As soon as the glass is cooled sufficiently to be form-sustaining, the inner mandrel or die is removed. A stripping element may be used, as well known, to assist in stripping the pre-shaped inner base structure from the inner mandrel, and to prevent adhesion of the glass base structure on the mandrel. Of course, the compression jaws, previously, have been opened to permit removal of the inner base structure. The glass unit 1, now formed with the dish-shaped extending flange 3, the intermediate portion 4, and the shaped end portion 2, in accordance with the desired form, is then tempered and ready for subsequent assembly into the lamp.

METHOD OF MAKING THE LAMP

The pre-heatable electrodes are preferably located on a stem, or melted into a bead; other melt-in processes are also suitable, for example holding the electrodes at their leads 13, 13', and then inserting the respective glass tubes 5, 5' into the end regions of the oval opening. The U-shaped tubes are so guided with their longer legs 6, 6' that the end portions 8*a*, which are not coated with fluorescent material, are surrounded by the terminal regions of the elongated or oval opening defined by the end portion 2 of the inner base structure 1. Upon assembly, the glass parts are heated to a temperature suitable to permit deformation of the glass, to be followed by a pressing or pinching step. During pinching or pressing, the alignment of the elements should be maintained carefully. By this pressing or pinching step, both seals to the two inner tubes 5, 5' in the press, as well as the seals to hold the filaments 12, 12' in position, can be carried out in one single working step. The manufacturing technology is similar to that of incandescent lamp manufacture.

Further handling, and finishing the lamp, is carried out by well-known and standard steps. The outer bulb 10 is melted to the rim 3, after positioning concentrically with respect to the inner base structure 1, by subjecting the rim and the bulb end portion to a suitable melt-on machine in which excess neck material of the lamp can drop off under gravity; alternatively, the neck of the lamp can be pre-heated to a suitable temperature and deformed by a roller which presses the neck of the lamp to the pre-heated rim 3 of the inner base structure 1. After exhausting the interior of the bulb through the previously positioned and melted-in exhaust tube 11, assembled for example at the same time as the electrodes 12, 12', the lamp is ready for attachment to a suitable base 14, 15, for example by cementing, as well known.

Various changes and modifications may be made, and any features described herein may be used with any of the others, within the scope of the inventive concept.

We claim:

1. A single-ended low-pressure discharge lamp, particularly a single-ended fluorescent lamp, having an inner base structure (1);

a base (14) receiving the inner base structure (1) of the lamp, and providing electrical terminals to an external socket;

an outer glass bulb (10) secured to the inner base structure (1) in gas-tight relation;

a fill comprising at least one of the materials of the group consisting of: gas; a metal vapor;

two pre-heatable electrodes (12, 12') secured to the inner base structure (1) and located inside the bulb (10); and at least one inner glass tube (5, 5') located within the bulb (10), the inner glass tube being bent into U shape to define a connecting bend portion and two parallel elongated leg portions (6, 7; 6', 7') open at their free ends (8, 9), a first (8) free end of one (6) of the leg portions surrounding one of the pre-heatable electrodes (12) and being melt-sealed thereinto in gas-tight relation, and a second free end (9) of the other (7) leg portion defining a communicating opening located within said inner base structure (1) with the interior of the bulb (10), wherein, in accordance with the invention, the inner base structure (1) comprises a unitary element, made of a glass compatible with and meltable to the bulb (10), having a cup-shaped or dished portion (3) forming an outwardly extending flange or rim (3) concentric with the major axis of the bulb and melt-connected with said bulb (10);

an axially projecting depending end portion (2), extending towards the base (14), which, in cross-section, has the shape of an elongated oval, the two pre-heatable electrodes (12, 12') and said first end (8) of the first leg (6) of the U-shaped tube (5) being melted into said depending end portion, and thereby secured to and supported within said inner base structure (1); and a hollow, generally cylindrical intermediate portion (4) joining the dished portion (3) and the end portion (2) and forming with said dished portion and said end portion a single, unitary base structure.

2. Lamp according to claim 1, wherein two U-shaped tubes (5, 5') are provided, each one having the first (8) free end of one (6) of the leg portions located at a lateral end of the oval formed by the projecting depending end portion (2), and each one having one of said pre-heatable electrodes sealed therein.

3. Lamp according to claim 2, wherein the longitudinal axes of the leg portions (6, 7; 6', 7') of said U-shaped tubes are located at least approximately at the corner points of a rhombus or a square, the diagonals of the rhombus or square having an intersecting point which is at least approximately coincident with the longitudinal axis of the lamp.

4. Lamp according to claim 1, wherein the first end (8) of the U-shaped tube, one of said electrodes (12) and the depending end portion (2) extending towards the base (14) of the inner base structure (1) forms a single press element, having a transverse dimension or length (L) corresponding at least approximately to the length of the depending end portion prior to the assembly of the tube, the electrode and the end portion in a press form.

5. Lamp according to claim 1, wherein the lamp bulb and the outwardly extending flange or rim (3) are melt-connected to form a gas-tight connection;

the flange or rim (3) and said melt connection being essentially circular with a center which is essentially coincident with the central axis of the lamp.

6. Lamp according to claim 1, wherein at least one of: the inner surface of the at least one inner glass U-shaped tube (5, 5'); the inner surface of the bulb (10)

is coated with a fluorescent light-emitting coating (5*a*, 10*a*).

7. Lamp according to claim 2, wherein the longitudinal axes of the leg portions (6, 7; 6', 7') of said U-shaped tubes are located at least approximately at the corner points of a rhomus or a square, the diagonals of the rhombus or square having an intersecting point which is at least approximately coincident with the longitudinal axis of the lamp;

the first ends (8) of the U-shapes tubes, each one of said electrodes (12, 12'), and the depending end portion (2) extending towards the base (14) of the inner base structure (1) form a single press element having a transverse dimension or length (L) corresponding at least approximately to the length of the depending end portion prior to the assembly of the tubes, the electrodes and the end portion in a press form; the second end (9) of the U-shaped tubes being located above said press form and thereby defining communicating openings with the interior of the bulb;

the lamp bulb and the outwardly extending flange or rim (3) are melt-connected to form a gas-tight connection;

the flange or rim (3) and said melt connection being essentially circular with a center which is essentially coincident with the central axis of the lamp; and at least one of:

the inner surfaces of the inner U-shaped tubes (5, 5');

the inner surface of the bulb (10)

is coated with fluorescent light-emitting coating (5*a*, 10*a*).

8. Lamp according to claim 6, wherein the fluorescent coating comprises a three-color fluorescent composition coating.

9. Lamp according to claim 1, wherein the inner surface of the bulb (10) comprises a light-diffusing surface (10*b*).

10. Lamp according to claim 7, wherein the fluorescent coating comprises a three-color fluorescent composition coating;

and wherein the inner surface of the bulb (10) comprises a light-diffusing surface (10*b*).

11. Lamp according to claim 1, further including a surrounding sleeve structure (15) of essentially cylindrical cross section extending from the base (14) and surrounding the region of the bulb where the dished portion (3) of the inner base structure (1) is melted to the bulb, and further surrounding the outer circumference of the intermediate cylindrical portion and at least part of the axially projecting depending end portion (2).

12. Method of making an inner glass base structure for a single-ended low-pressure discharge lamp in which a cylindrical, tubular glass starting element is deformed, comprising the steps of mounting the glass starting element on a rotating support, rotating the support and heating an end portion of the tubular, cylindrical element, and deforming said end portion to form a laterally outwardly extending flange (3);

introducing a die within the cylindrical, tubular portion, said die having a portion which is essentially cylindrical, and an adjacent portion which is oval and matches the inner shape of a press zone or portion (2) to be formed on the glass starting element;

rotating said support and heating the portion of the glass starting element in the region opposite said oval zone of the die to glass softening temperature;

stopping rotation of the support and hence of the glass starting element, and compressing the portion of the glass starting element surrounding the oval zone of the die to form an axially projecting depending end or support portion (2) spaced from the flange (3) by an intermediate, essentially cylindrical portion; and opening said jaws, and removing the finished inner glass base structure from the die by stripping the structure from the die during relative axial movement of the finished inner base structure and said die.

13. Method of making a single-ended low-pressure discharge lamp, such as a single-ended fluorescent lamp, having an inner base structure (1), an outer glass bulb (10) and two pre-heatable electrodes (12, 12') secured to the inner base structure and located inside the bulb, and at least one glass inner tube (5, 5') located within the bulb, the inner tube being bent into U-shape to define a bent connecting portion and two parallel, elongated leg portions (6, 7), open at their free ends (8, 9), wherein the inner base structure comprises a unitary glass element made of a glass compatible with and meltable to the bulb, and includes a cup-shaped dished portion (3) forming an outwardly extending flange or rim (3) concentric with the major axis of the bulb, an axially projecting depending end portion (2) extending in a direction away from the bulb which, in cross section, has an oval, longitudinal shape and a hollow cylindrical intermediate portion, joining the dished portion (3) and the end portion, and forming with said dished portion and said end portion a single, unitary base structure, comprising the steps of positioning the pre-heatable electrodes with respect to the inner base structure such that the electrodes are located within the axially projecting depending end portion (2) of the inner base structure;

introducing one end (8) of the U-shaped inner tube (5, 5') within the axially projecting depending end portion at the rounded end region of the oval, and surrounding one of the electrodes (12, 12');

heating the axially projecting depending end portion (2) of the inner base structure (1) to a temperature permitting deformation of the glass of the inner base structure and the glass of the U-shaped tube;

pressing the softened glass portions together to, simultaneously, and in one step:

seal the electrodes into the thus formed press, seal the end (8) of the U-shaped tube in the thus formed press, and thereby connecting, in gas-tight, air-tight relation, the projecting depending end or support structure (2), the U-shaped tube, and the electrode within the U-shaped tube, to form an inner base structure—electrode—discharge tube subassembly;

placing the bulb (10) over said subassembly with an open portion of the bulb extending beyond the outwardly extending flange or rim (3);

rotating the subassembly and the bulb, and heating said flange or rim and the bulb in the region of alignment with the flange or rim to a temperature suitable for deformation of glass;

and melting the adjacent regions of the bulb and the flange together.

14. Method according to claim 13, wherein said melting step comprises heating the bulb to a temperature at which the portion of the bulb projecting beyond the rim separates, due to its own weight, from the remainder of the bulb, and the separation zone, being molten, melts unto said rim or flange.

15. Method according to claim 13, wherein the step of melting the bulb (10) to the rim or flange (3) comprises pressing a rim or edge portion of the bulb against the rim or flange by means of a roller, and effecting a gas-tight compression melt connection between the bulb and said rim or flange.

16. Method according to claim 13, further including the step of introducing an exhaust tube (11) through the inner base structure prior to the step of heating the inner base structure, the end portion of the U-shaped tube and the electrode to glass-melting together and deformation temperature so that, upon the subsequent pressing step, the exhaust tube will be melted into the axially projecting depending end portion (2) and will form part of said subassembly.

17. Method according to claim 13, wherein the step of introducing the electrodes into the inner base structure comprises positioning the electrodes adjacent the end regions of the oval formed by the axially projecting depending end portion (2);

and two U-shaped inner tubes are introduced into said inner base structure, one, each, having an end portion surrounding one, each, of the electrodes, the other free end portion (9) of the U-shaped tubes being foreshortened with respect to said one end portion and positioned above said depending end portion (2) of the inner base structure to provide for free communication of said other end portion (9) with the interior of the lamp, when assembled with the bulb;

and said heating and pressing steps comprise heating both the end portions (8) of both said U-shaped tubes (5, 5') and, in one working step, securing and pressing the end portions (8) of both said U-shaped tubes in the axially projecting depending end portion (2) of the inner base structure (1) to form a composite subassembly of two electrodes, each within a U-shaped tube, two such tubes, and the inner base structure (1).

18. Method according to claim 17, further including the step of applying a fluorescent phosphor to the interior of said U-shaped tubes prior to assembly of the tubes into the inner base structure (1) while leaving free the extending end portion (8) positioned within the axially projecting depending end portion (2) of the inner base structure to leave the portion which subsequently is heated and pressed to form the composite subassembly free from fluorescent material.

* * * * *